US006242104B1

(12) United States Patent
Taylor et al.

(10) Patent No.: US 6,242,104 B1
(45) Date of Patent: Jun. 5, 2001

(54) PRECIOUS METAL COMPOSITION AND ARTIFACTS MADE THEREFROM

(75) Inventors: Stefanie S. Taylor, Fourways; Taryn Biggs, Greenside; Van Reenen Pretorius, Greymont, all of (ZA)

(73) Assignee: Implico B.V., Amsterdam (NL)

( * ) Notice: Subject to any disclaimer, the term of this patent is extended or adjusted under 35 U.S.C. 154(b) by 0 days.

(21) Appl. No.: 09/066,347

(22) PCT Filed: Oct. 28, 1996

(86) PCT No.: PCT/NL96/00420

§ 371 Date: Aug. 12, 1998

§ 102(e) Date: Aug. 12, 1998

(87) PCT Pub. No.: WO97/15694

PCT Pub. Date: May 1, 1997

(30) Foreign Application Priority Data

Oct. 27, 1995 (ZA) ..... 95/7227

(51) Int. Cl.[7] ..... C22C 5/04
(52) U.S. Cl. ..... 428/544; 420/466
(58) Field of Search ..... 420/461–468; 428/544

(56) References Cited

U.S. PATENT DOCUMENTS 1,545,234 * 7/1925 Cohn .
2,129,721 * 9/1938 Wise .
2,189,571 * 2/1940 Sivil et al. .
2,273,805 * 2/1942 Wise et al. .
2,273,806 * 2/1942 Wise et al. .
2,279,763 * 4/1942 Sivil .
3,622,310 * 11/1971 Reinacher .
3,640,705 * 2/1972 Selman et al. .
4,165,983 * 8/1979 Bourne et al. .
4,828,933 * 5/1989 McGill et al. .
5,518,691 * 5/1996 Muragishi et al. .

FOREIGN PATENT DOCUMENTS 0284699 5/1988 (EP) .
274239A1 * 7/1988 (EP) .
0421731 10/1991 (EP) .

OTHER PUBLICATIONS

Binary Alloy Phase Diagrams, Second Edition, vol. 1 (2 pages), 1986 (No Month).

* cited by examiner

*Primary Examiner*—Deborah Jones
*Assistant Examiner*—Jennifer McNeil
(74) *Attorney, Agent, or Firm*—Christie, Parker & Hale, LLP

(57) ABSTRACT

A decorative artifact made of a precious metal composition containing 3–9% by weight aluminum, 1–6% by weight titanium, and the balance being platinum, in which the hardness of the composition is at least 600 on the Vickers scale.

4 Claims, No Drawings

PRECIOUS METAL COMPOSITION AND ARTIFACTS MADE THEREFROM

FIELD OF THE INVENTION

This invention relates to precious metal compositions having unique physical properties and to artifacts made therefrom. More particularly, but not exclusively, the invention relates to precious metal artifacts which are hard enough to be faceted and/or polished using techniques commonly used on gemstones; and, have a composition which may be selected to ensure that the precious metal conforms to required hallmarking regulations, particularly insofar as platinum and gold materials are concerned.

The artifacts may assume the form of faceted or polished cabochon "gemstones" or wrist- or other watch casings, facings and dials and straps as well as non-faceted watch casings, facings, dials and straps or any other decorative artifacts which do not require material workability for their production. Such artifacts will be generally termed "decorative artifacts" herein. It is to be understood that the term cabochon means an artifact having a non-faceted domed surface of widely variable shape in plan view.

BACKGROUND TO THE INVENTION

There are no naturally occurring, silver-coloured, metallic gem materials with a precious metal, in particular platinum content sufficiently high to provide a high intrinsic value, and in particular, to be hallmarkable, and with a Mohs hardness greater than 5.

Pure platinum and platinum alloys with Vickers hardnesses between 50 and 300 are too soft to be cut, optionally faceted, and polished to form durable "gemstones". Synthetic and natural gemstones used in the production of watch casings, facings or dials generally have Moh's hardness greater than 5 and the commonly used sapphire (corundum) has a Mohs hardness of 9. This ensures good polish and suitable wear properties. Natural metallic gemstones such as haematite have Mohs hardnesses of 6.5 to 7.5.

Pure platinum and existing platinum alloys cannot approach these hardness values. Even existing hard platinum alloys are not sufficiently scratch resistant to prevent scratches tom dulling the polished surface.

Other methods of increasing the hardness of platinum involve surface treatments. Hardness values of up to 700 Vickers (Mohs hardness 6) have been reported, sufficiently hard to polish to a highly reflective surface finish. However, only a thin surface layer up to 200 micrometres thick is affected and polishing, finishing, wear etc could result in compromising the integrity of the layer. Furthermore, these surface layers are often brittle, prohibiting subsequent mechanical work.

Plating finished platinum articles can also give a highly reflective surface finish, but has the disadvantage that it can discolour, wear off and needs expertise if it is to be done well.

Coloured platinum intermetallic compounds have been described in the prior art in South African Patent No. 90/7777. This product, unfortunately, suffers from two disadvantages, namely:

(i) it does not produce a silver coloured material, and, (ii) the platinum content is too low to conform to most, if not all, hallmarking requirements.

In the case of platinum, relatively high platinum contents are required for hallmarking purposes such as, for example, in the case of Japan, not less than 85 weight percent; and in the case of the USA, not less than 95 weight percent platinum. In the USA an alternative is that there be 50% platinum by weight with the balance of the 95%, namely 45%, comprising other platinum group metals. In Europe, the requirement is commonly 95 weight percent platinum.

OBJECT OF THE INVENTION

It is an object of this invention to provide hard, durable, alloys and compounds based on precious metals having a sufficiently high content of precious metal to enable it to conform to hallmarking standards and also which is capable of being faceted to provide metallic "gemstones".

It is to be understood that in this specification the term "alloying metal" will be employed whether or not the alloying metal forms a solid solution or immiscible composite with the dominant precious metal, or it forms an intermetailic compound with such precious metal, or a two-phase mixture of the two.

SUMMARY OF THE INVENTION

In accordance with this invention there is provided a decorative artifact made of a precious metal composition containing a minimum of 55% by weight platinum group metal with a total precious metal content of at least 80% by weight, together with one or more alloying elements, and wherein the proportions of the various elements are chosen such that the precious metal composition includes intermetallic compounds and always has a Vickers hardness of at least 600.

The fact that the composition always has a Vickers hardness of at least 600 means that it cannot be softened to a lesser hardness by any process or heat treatment. Further features of the invention provide for the precious metal composition to conform to a required standard, in particular a hallmarking standard; for the precious metal to be predominantly platinum; for the precious metal, and more particularly the platinum group metal content to be greater than 85%, and more preferably greater than 90% by weight; for the alloying metals, in the case of platinum as the platinum group metal, to be titanium and aluminium in amounts from about 1 to 6% in the case of titanium, and 3–9% in the case of aluminium; and for the Vickers hardness to be greater than 650 and preferably greater than 700.

Platinum material which contains at least 85 weight percent platinum with the balance being aluminium may contain any one or more of the intermetallic phases $Pt_3Al$, $Pt_5Al_3$, PtAl or $Pt_2Al$; or any of these structures where titanium has partially substituted for platinum or aluminium.

The high hardness of these compositions implies that they can take a high polish or finish and develop colour.

EXPERIMENTAL TESTS

In order to test the invention, artifacts were produced from four different precious metal compositions based on platinum by melting appropriate compositions of platinum, aluminium and titanium in an electric arc furnace under an inert atmosphere, in particular argon, to produce button-shaped melts. The samples were cooled, turned over and re-melted twice to ensure homogeneity.

The buttons contained intermetallic compounds and were cut and polished using standard faceting and polishing techniques to provide "gemstones".

The various compositions produced were as follows:

| Weight % | | | |
|---|---|---|---|
| Pt | Ti | Al | Vickers hardness 10 kg load |
| 91.5 | 1 | 7.5 | 713 ± 24 |
| 91.5 | 2 | 6.5 | 724 ± 15 |
| 90.0 | 3.3 | 6.7 | 897 ± 24 |
| 92.0 | 1.5 | 6.5 | 679 ± 44 |

It is to be noted that a Vickers hardness of around 700–800 is equivalent to 6 to 6,5 Mohs.

It will be seen that numerous compositions are possible within the scope of this invention provided they conform to the required hardness of 650 to 800 specified above.

What is claimed is:

1. A precious metal composition comprising from 1% to 6% by weight titanium, and 3% to 9% by weight aluminum, the balance being platinum and unavoidable impurities, wherein the proportions of the various elements are chosen such that the composition includes intermetallic compounds and always has a Vickers hardness of at least 600.

2. The precious metal composition of claim 1, wherein the composition includes at least one intermetallic phase selected from the group consisting of $Pt_3Al$, $Pt_5Al_3$, PtAl, and $Pt_2Al$, wherein the platinum or aluminum may optionally be partially replaced with titanium.

3. A decorative artifact manufactured from the composition of claim 1 or claim 2.

4. A precious metal composition comprising from 1% to 6% by weight titanium, and 3% to 9% by weight aluminum, the balance being essentially platinum, wherein the proportions of the various elements are chosen such that the composition includes intermetallic compounds and always has a Vickers hardness of at least 600.

* * * * *